US007909591B2

(12) United States Patent
Kachele

(10) Patent No.: US 7,909,591 B2
(45) Date of Patent: Mar. 22, 2011

(54) ECCENTRIC SCREW PUMP EQUIPPED WITH EROSION-RESISTANT ROTOR

(75) Inventor: Bruno Kachele, Weilheim/Teck (DE)

(73) Assignee: Wilhem Kachele GmbH, Weilheim/Tech (DE)

( * ) Notice: Subject to any disclaimer, the term of this patent is extended or adjusted under 35 U.S.C. 154(b) by 813 days.

(21) Appl. No.: 10/569,247

(22) PCT Filed: Aug. 14, 2004

(86) PCT No.: PCT/EP2004/009141
§ 371 (c)(1),
(2), (4) Date: Sep. 15, 2006

(87) PCT Pub. No.: WO2005/021971
PCT Pub. Date: Mar. 10, 2005

(65) Prior Publication Data

US 2007/0140882 A1 Jun. 21, 2007

(30) Foreign Application Priority Data

Aug. 22, 2003 (DE) ..... 103 38 632

(51) Int. Cl.
*F01C 1/10* (2006.01)
*F01C 5/00* (2006.01)
*F03C 2/00* (2006.01)

(52) U.S. Cl. ..... 418/48; 418/1; 418/179; 29/888.023; 29/447

(58) Field of Classification Search ..... 418/1, 48, 418/178, 179; 29/447, 508, 516, 517, 525.14, 29/888.023
See application file for complete search history.

(56) References Cited

U.S. PATENT DOCUMENTS

| | | | | |
|---|---|---|---|---|
| 2,028,407 | A * | 1/1936 | Moineau | 418/48 |
| 2,464,011 | A * | 3/1949 | Wade | 418/48 |
| 6,491,142 | B2 * | 12/2002 | Takahashi et al. | 188/218 XL |
| 6,544,015 | B1 * | 4/2003 | Kaechele | 418/48 |

FOREIGN PATENT DOCUMENTS

| | | | |
|---|---|---|---|
| CA | 2387833 | A1 * | 10/2000 |
| DE | 1816462 | | 7/1970 |
| DE | 2240423 | | 3/1974 |
| DE | 2918602 | | 11/1980 |
| DE | 2918602 | A * | 11/1980 |
| DE | 19852380 | C2 | 5/2000 |

* cited by examiner

*Primary Examiner* — Theresa Trieu
(74) *Attorney, Agent, or Firm* — Leydig, Voit & Mayer, Ltd.

(57) ABSTRACT

An eccentric screw pump or an eccentric screw motor has a rotor formed from at least a tubular jacket with at least two layers. The outer layer of the jacket consists of a material that is abrasion-resistant and/or corrosion-resistant.

21 Claims, 4 Drawing Sheets

ECCENTRIC SCREW PUMP EQUIPPED WITH EROSION-RESISTANT ROTOR

BACKGROUND OF THE INVENTION

A rotor for an eccentric screw pump or eccentric screw motor produced by cold deformation is disclosed in DE 198 52 380 A1. The pump or motor of this reference has a stator with a continuous helical opening over which the rotor rolls during displacement operation. The stator comprises a cylindrical tube provided with an elastomeric cladding. The elastomeric cladding defines the wall of the passage opening and acts as a seal relative to the stator.

The stator includes a core element and a shell formed around the core element. Beginning with a cylindrical tube, the shell is deformed into a helical configuration. The originally cylindrically shaped tube acquires not only the helical configuration, which is required for the rotor, but this deformation also firmly connects the tube to the core element. In the final state, the thread valleys of the shell of the stator form a tight firm friction fit with the core element. To improve the driving effect between the core element and the shell of the stator, the support element also can be provided with longitudinal ribs.

This prior art rotor can be produced in a cost effective manner in very large numbers. Lengths of up to 6 meters can be reached easily without requiring final machining of the surface of the stator. The surface of the rotor is very smooth and sufficiently stable in its dimensions. The core element present in the shell prevents the rotor from uncoiling when exposed to pressure. Uncoiling of the rotor could lead to a pitch error between the stator and rotor that would result in leaks.

This prior art rotor is made of a steel material that does not have sufficient wear strength for many applications, and also does not have sufficient corrosion-resistance for some applications. In other words, the rotor does not have sufficient erosion resistance. Erosion is understood to mean not only wear by corrosion, but also ablation by sliding abrasion of the transported material on the surface.

It is also known from the prior art to provide the stator with a shell that has a helical configuration similar to the helical configuration of the passage opening. With such stators, the elastomeric cladding, which again serves as sealing material, has an almost constant wall thickness. Larger pressures, or larger torques in the case of an eccentric screw motor, can be produced with such stators.

BRIEF SUMMARY OF THE INVENTION

In view of the foregoing, a general object of the invention is to provide an eccentric screw pump or an eccentric screw motor in which the rotor is characterized by better erosion resistance. Another general object of the invention is to provide a method for producing a rotor having greater erosion resistance.

The rotor in the eccentric screw pump or screw motor according to the invention is designed like a sandwich. The rotor consists of a radially inner layer and a radially outer layer with the radially outer layer being especially adapted to provide higher erosion resistance. In particular, the radially outer layer can be more abrasion-resistant or more corrosion-resistant or both than the radially inner layer.

Since more corrosion-resistant materials having larger wall thicknesses are in some circumstances more difficult to deform and are much more expensive than the radially inner layer, the radially inner layer can primarily be chosen from a standpoint of strength and cost, so that it is possible to use a very thin radially outer layer.

The rotor can have a very homogeneous structure if the inner layer consists of a seamless tube. Such an arrangement helps avoid heterogeneities, which otherwise occur during welding. Such heterogeneities could continue outward as shape defects. However, it is also possible to use a wound tube as the inner tube in the present invention. Such a tube is preferably laser-welded at the helical butt joint. The coil should run opposite the coil of the outer layer.

The inner layer or the inner tube consists of an easily deformable steel material that is can transfer the recurrent forces and be cold-worked in the usual manner. The outer layer can consist of an attached tube. Such a configuration, however, is only suitable for rotors with a relatively short design length. In rotors with a relatively longer design length, the outer layer can be formed from a wrapped metal band. The metal band is wrapped with butt joints so that the individual windings abut each other without a gap. A particularly good arrangement is produced if the helically running joint where the windings abut is welded before cold deformation. The welding is preferably done with a laser.

Stainless steels V2A, V4A steel or other abrasion-resistant steels can be used as the outer material. Since these materials have a very much higher specific weight than normal steel, the two-layer design also results in a weight saving as compared to a rotor made only of stainless steel. This can play a role in rotors with a length of up to 6 meters.

The strength of the rotor can be improved if it includes a core element. The rotor can be molded around the core element so that a good connection with the core element is produced. The core element prevents uncoiling of the rotor under load at great lengths. In addition, additional torque can be introduced over the length of the rotor by means of the core element. The substantially rotationally symmetric and non-helical core is better suited for this purpose. The core element can be tubular or solid. In addition, the intermediate space between the tube or shell of the rotor and the core element can be either left open or filled with a mass.

According to the method of the invention, a cylindrical tube is prepared first. The tube is enclosed with a metal layer so that a double-walled structure is produced. The double-walled structure, which is still cylindrical, is then helically deformed. Covering of the cylindrical tube with the outer layer is very simple of the simple geometric shape of the already prepared tube. Because the stability of the rotor can be achieved under some circumstances primarily with the inner tube, the outer layer only has to be applied with a limited thickness and thus materials that can not be cold deformed at greater wall thicknesses can also be used for the outer layer.

A seamless tube can be used in the method according to the invention. The seamless tube advantageously has a bright metallic surface so that connection of the outer layer with the tube by cold deformation is not hampered by oxide residues.

The outer metal layer in the simplest case consists of a metal band wrapped around the tube. To increase the tension the metal band can be heated immediately ahead of the contact site before winding. Subsequent cooling ensures shrinkage that holds the metal band particularly tightly on the surface of the tube. The butt joint between the adjacent windings can be welded in order to prevent penetration of particles.

The resultant double-walled structure is cold deformed. During the deformation process, the outer layer is bonded to the inner tube in at least a point-like manner, as is also the case during lamination. As a result, the connection is particular durable, and also is not broken by fluctuating temperatures.

According to the method of the invention, a core element can be inserted before deformation of the coated tube.

An embodiment of the invention is shown in the drawings. In the drawings:

BRIEF DESCRIPTION OF THE SEVERAL VIEWS OF THE DRAWING(S)

DETAILED DESCRIPTION OF THE INVENTION

Figure 1:
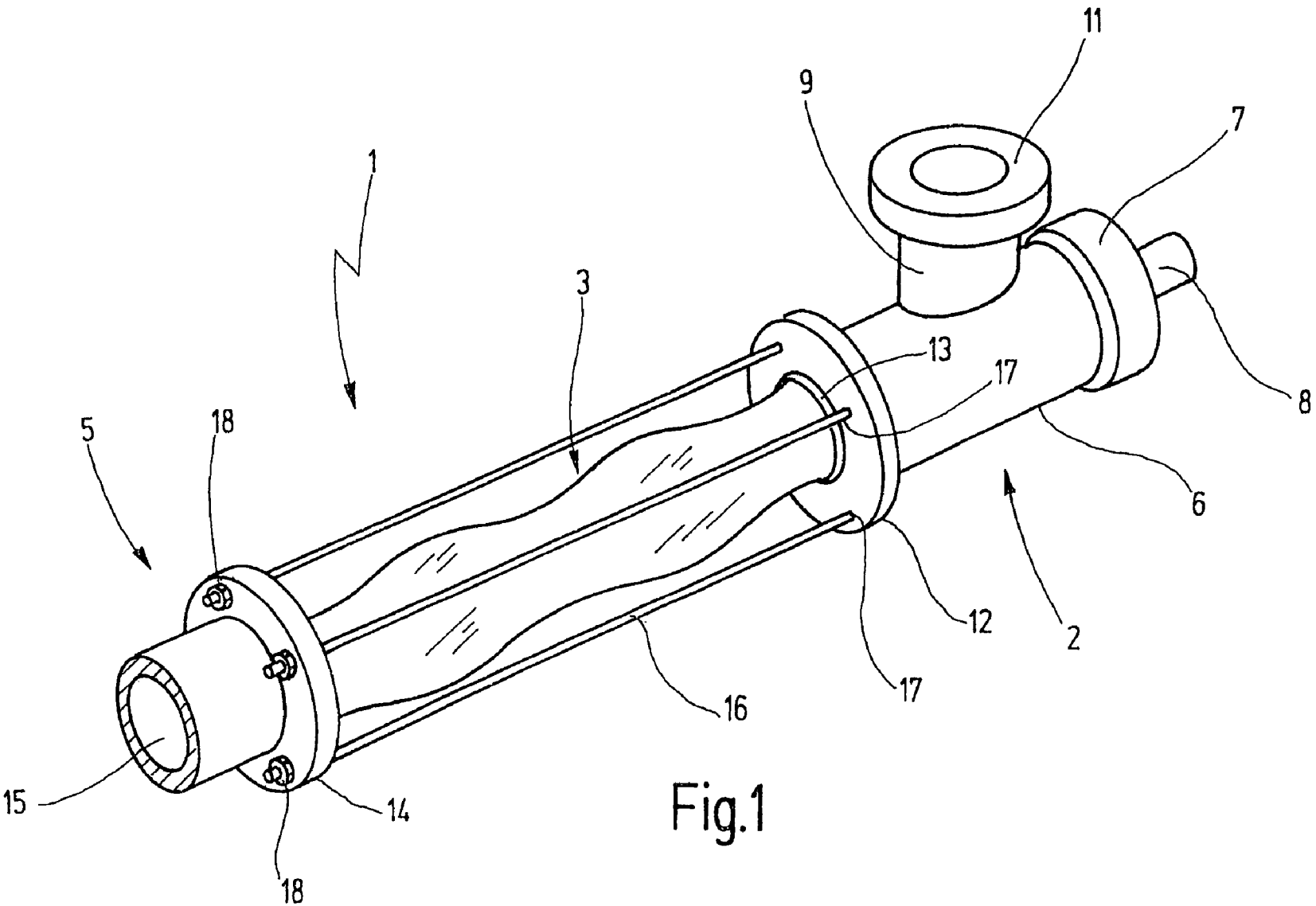
FIG. 1 is partially cutaway perspective view of an illustrative eccentric screw pump according to the present invention.

A schematized, oblique view an eccentric screw pump 1 according to the invention is shown in FIG. 1. The eccentric screw pump 1 includes a pump head 2, a stator 3 in which a rotor 4 rotates, as well as a connection head 5. The pump head 2 has a substantially cylindrical housing 6, which includes a closure cover 7 on one end with a closure cover 7. A drive shaft 8 is guided outward in sealed fashion through the closure cover 7. A connector 9 discharges radially into housing 6. The housing 6 ends in a fastening flange 11. As is common in eccentric screw pumps, the coupling piece for torque-proof coupling the drive shaft 8 (which is connected to a drive motor) to the rotor 4 is situated inside the housing 6.

The end of the housing 6 that is remote from the cover 7 is provided with a tightening flange 12 that has a diameter greater than the diameter of the substantially cylindrical housing 6. The tightening flange 12 has a stepped hole 13 that is aligned with the internal space of housing 6. A contact shoulder is formed in the stepped hole, against which one end of the stator 3 is pressed.

The connection head 5 has a tightening flange 14 that cooperates with the tightening flange 12. The tightening flange 14 also contains a stepped hole in which the other end of the stator 3 is inserted. A discharge line 15 is aligned with the stepped hole.

The stator 3 is firmly tightened in sealed fashion between the tightening flanges 12 and 14 by in this case four tie bolts 16. In order to accommodate the four tie bolts 16, the two tightening flanges 12 and 14 are each provided with four aligned holes 17 that lie on a circular area larger than the outside diameter of housing 6 or tube 15. The rod-like tie bolts 16 are passed through these holes 17. Nuts 18 are threaded onto each tie bolt 16 on the side facing away from the opposite tightening flange 12 and 14, by means of which the two tightening flanges 12 and 14 are tightened to each other.

Figure 2:
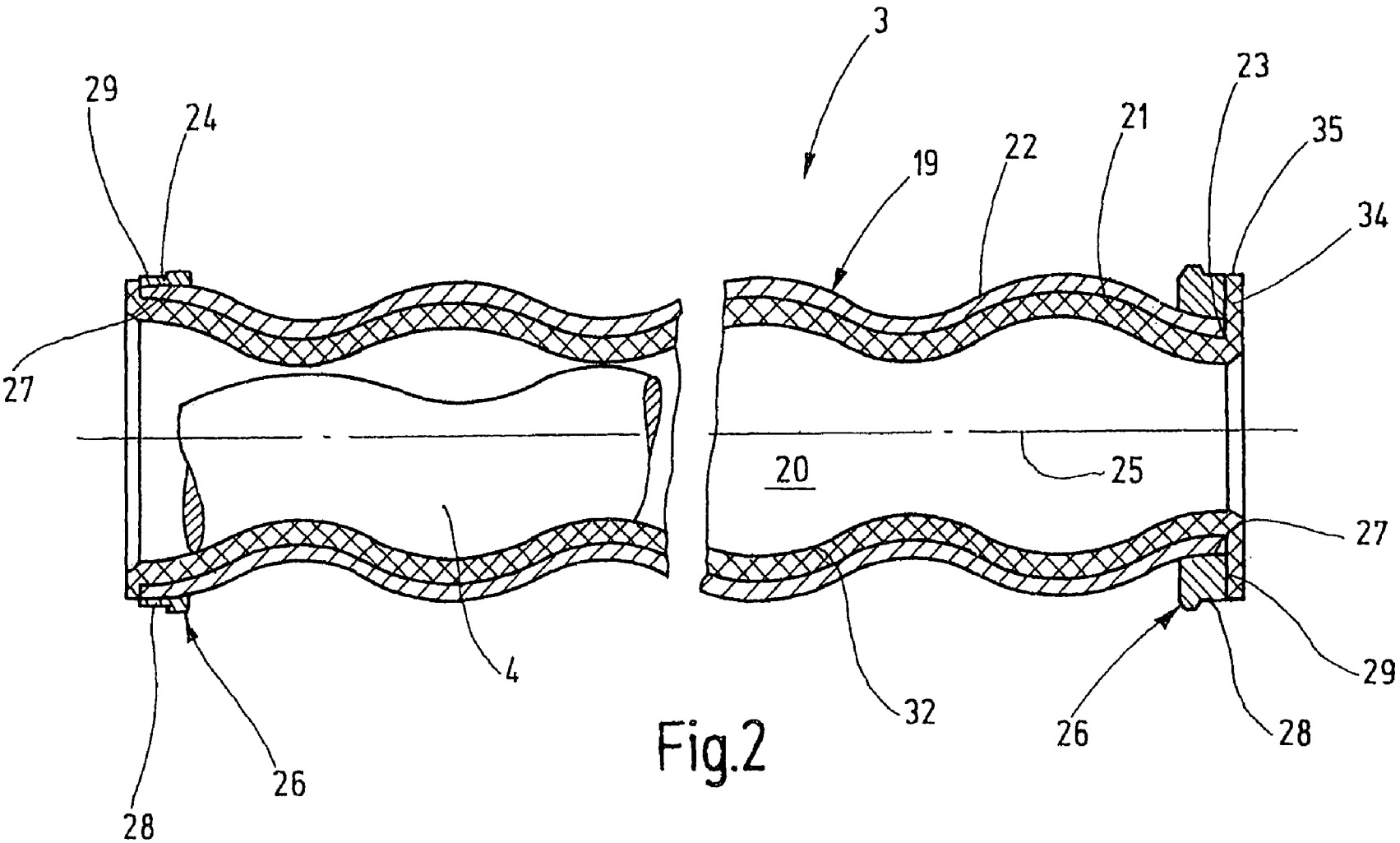
FIG. 2 is a longitudinal section view taken through the stator of the eccentric screw pump of FIG. 1.

As shown in FIG. 2, the stator 3 consists of a tubular shell 19 with constant wall thickness that surrounds an inner space 20. The shell 19 consists of steel, steel alloy, light metal or a light metal alloy. The shell 19 is shaped so that its inside wall 21 acquires the outer configuration of a multiple start screw. The outside surface 22 of the shell 19 has a similar matching shape with a diameter greater than the diameter of the inner space of the shell 19 according to the wall thickness. The shell 19 terminates at end surfaces 23 and 24 which are oriented at right angles relative to the longitudinal axis 25 of the shell. The longitudinal axis 25 is the axis of the inner space 20.

In the simplest case, the internal space 20 has the shape of a two-start screw. The cross-section enclosed by the outer surface 22 when viewed at a right angle to the longitudinal axis 25 also has the shape of an oval, similar to a racetrack. In order to adapt the geometry to the stepped hole 13, a closure or reducing ring 26 is seated on each end of the shell 19. Alternatively, the ends can also be formed as cylindrical tubes. The closure ring 26 has a passage opening 27 that coincides with the course of the outer surface 22 over the longitudinal extent of the closure ring 26. In other words, the closure ring 26 acts in the broadest sense as a nut, which is screwed onto the thread defined by the shell 19. The length of the thread corresponds to the thickness of the closure ring 26.

The closure ring 26 is bounded in the radially outward direction by a cylindrical surface 28, which transitions axially into a flat surface 29 that faces away from the shell 19. On the inner side 21, the shell 19 is provided over its entire length with a continuous cladding 32. The cladding 32 consists of an elastically flexible, preferably elastomeric material (e.g., natural rubber or a synthetic material) and has roughly the same wall thickness at each location.

Figure 3:
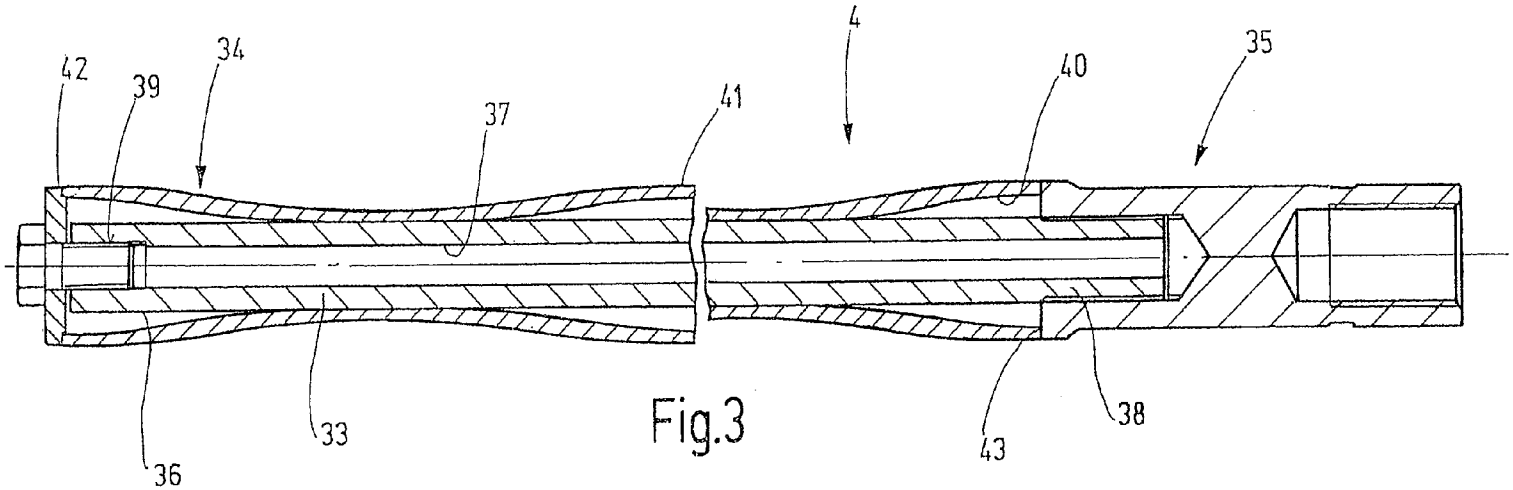
FIG. 3 is a longitudinal section view taken through the rotor of the eccentric screw pump of FIG. 1.

As shown in FIG. 3, the rotor 4 includes a core element 33, a rotor jacket 34, and a coupling head 35. The core element 33 in the illustrated embodiment is a thick-walled steel tube with an at least originally cylindrical outer peripheral surface 36 and a continuous cylindrical internal space 37.

The core element 33 has a straight configuration as well as a tubular configuration as the internal space makes no noticeable contribution to the strength, but merely increases the weight. However, the core element can also be solid. As shown in FIG. 3, the core element has one threaded end 38 (the right end with reference to FIG. 3). The opposing end of the core element 33 includes a threaded hole 39.

The jacket 34 of the rotor 4 also has a tubular configuration including an inner wall 40 and an outside surface 41. The outside surface 41 forms a thread that continues over the entire axial length of the jacket 34. The thread begins at 42 and ends at 43. The number of turns of the thread formed by the outer surface 41 is one fewer than the number of turns in the passage opening 20 in stator 3. As shown in the cross section of FIG. 4, the rotor 4 in the illustrated embodiment has a four-start thread, i.e., a total of four strips run helically along the jacket 34. The passage opening 20 accordingly has five starts. The five-start threads in the passage opening 20 are formed with a total of five helically extending strips made of elastomeric material.

Figure 4:
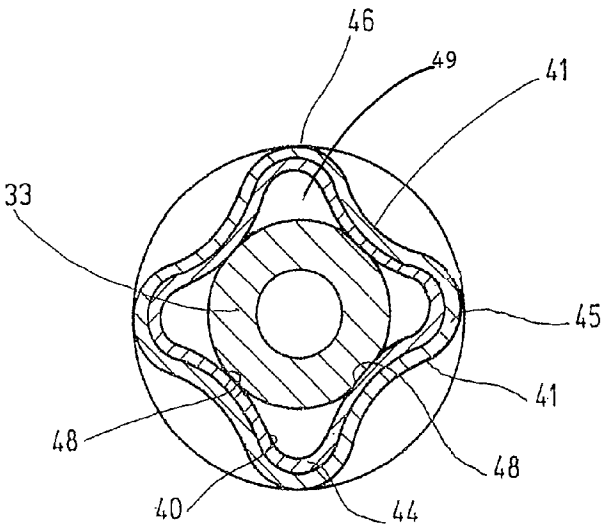
FIG. 4 is a cross section view taken through the rotor of FIG. 3.

As shown in FIG. 4, the rotor jacket 34 is two-layered, including an inner layer 44 and an outer layer 45 situated on the inner layer. The inner layer 44 consists of an originally cylindrical steel tube having good deformability and strength for the given applications. The outer layer 45, in turn, consists of an erosion-resistant material, which is a material that is resistant to being worn or ground off and/or chemically attacked by the medium being pumped. An appropriate material for the outer layer is, for example, stainless steel like V2A or V4A. The wall thickness of the inner layer 44 can be between 1 mm and 5 mm, while the wall thickness of the outer layer 45 also can be between 1 mm and 5 mm. Production of this rotor 4 is explained further below by means of FIG. 5. As previously discussed, the jacket 34 has a tubular configuration, and as a result, the inner surface 40 follows the outer surface 41 at constant spacing.

Because of the screw-like configuration of the jacket 34, the outer surface 41 when viewed in the longitudinal direction, forms an alternating sequence of thread crests 46 and thread valleys 47. As a result of the multiple starts, the thread valleys 47 and the thread crests 46 appear not only in the longitudinal direction, but also in each sectional plane in the circumferential direction as shown in FIG. 4.

The dimensions of the cylindrical straight tube from which the jacket 34 is cold-deformed are chosen so that after final deformation to the helical configuration, the jacket 34 at least touches the outside peripheral surface 36 of the core element 33 with its inside peripheral surface 40 in the area of the thread valleys 47 (with reference to the outer contour). During correspondingly stronger deformations it is also possible to slightly deform the outer peripheral surface 36 of the core element 33 so that its outer peripheral surface 36 acquires shallow grooves 48 that follow the contour of the thread valleys 47. If deformation is continued in this way, then not only a frictional but also a form-fit connection results between the jacket 34 and the core element 33 in the region of the thread valleys 47 that curve toward the interior of jacket 34 with the core element 33. Moreover, because of the deformation, cold welding between the jacket 34 and core element 33 can even occur at the contact sites.

Since the semifinished product from which the jacket 34 is produced is a cylindrical tube whose diameter is greater than the outside diameter of the core element 33, intermediate spaces 49 are formed that extend helically between the core element 33 and the jacket 34. The number of helical screw intermediate spaces 49 is equal to the number of thread crests 46, which are apparent in the cross section of the rotor 4 in the circumferential direction. Depending on the application, these intermediate spaces 49 can either be left empty or filled with a mass. This mass, for example, can be a synthetic resin or synthetic resin filled with light metal powder.

Figure 5:
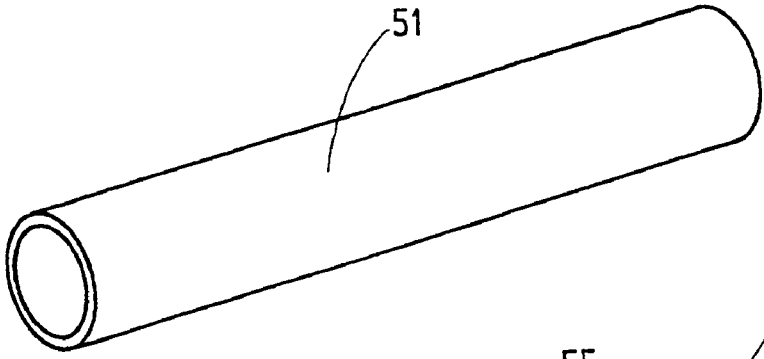
FIGS. 5-7 are schematic drawings showing some of the steps associated with the an exemplary method according to the invention for producing the rotor of the eccentric screw pump of FIG. 1.
Figure 6:
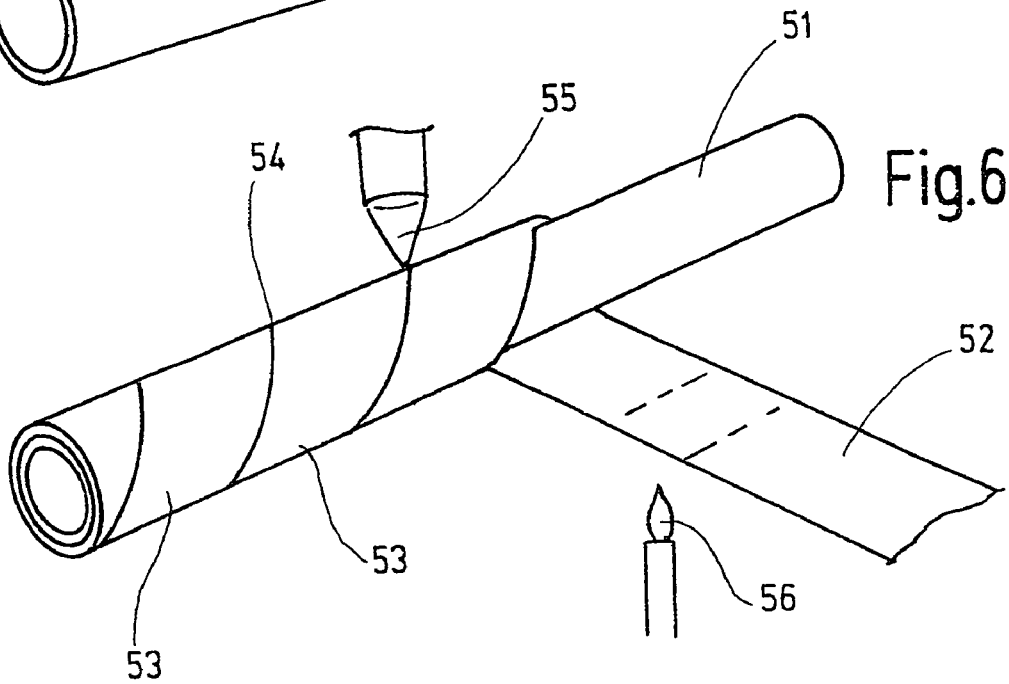
Figure 7:
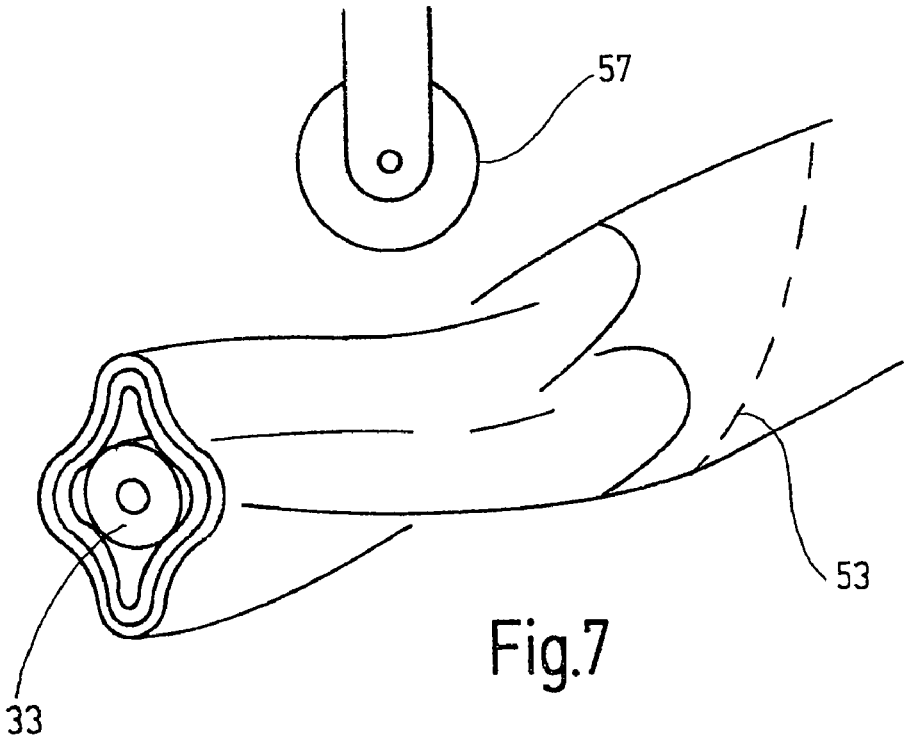

One embodiment of the method of production of the rotor 4 including layers 44 and 45 is shown in schematic fashion in FIGS. 5 to 7. Initially, a bright drawn, seamless steel tube 51 with a suitable wall thickness and an appropriate length of several meters is prepared. The steel tube 51 is wrapped on the outside with a metal band 52, which later forms the outer layer 45. The metal band 52 is a band made of an appropriate stainless steel or another steel material. The band 42, as shown in FIG. 6, is wrapped like a single-thread screw onto the outside of steel tube 51. Windings 53 lying next to each other are then formed. The windings 52 are separated from each other by a helical butt joint 54. The wrapping of the metal band 52 is performed so that the butt joint 54 is as closed as possible.

During winding or in a separate step, the butt joint 54 is welded by means of a laser beam 55 and filler material in order to achieve a smooth, homogeneous cylindrical surface. Other welding methods can also be used. The welding can be carried out such that the band 52 is joined to the support tube 51 with a substance-to-substance bond in the area of the butt joint 54.

The metal band 52 is heated, for example, by a gas flame 56 or inductively, immediately before it is placed on tube 51. This enables the metal band 52 to produce a significant pressure in the circumferential direction after it is wrapped onto the tube 51 and cooled. After the band 52 has been wrapped over the entire length of the tube 51 and the butt joint 54 has been welded over the entire length, the core element 33 is inserted according to FIG. 7. The structure is then brought to the desired helical shape by cold deformation, for example, by rolling with a plurality of rolls (one such roll is referenced in the drawings as 57). During rolling, the metal band 52 is bonded very intimately with the outside surface of the underlying steel tube 51.

After the process step shown in FIG. 6 is completed, the metal band 52 forms a second outer tube on the metal steel tube 51. The metal band 52 is seated firmly and with circumferential tension in a friction fit with the outside peripheral surface of tube 51. The two tubes, namely the tube formed by wrapping and the seamless inner steel tube, are already so firmly joined to each other after wrapping that they can no longer be separated from each other.

The subsequent rolling process shown in FIG. 7 ensures more intimate bonding, which at least to a certain degree is similar to plating with a metal layer. The rolling, which generally leads to stretching of a metal piece, surprisingly does not separate the outer tube from the tube 51 situated beneath it. Instead, the two tubes are deformed together into the desired helical shape, intimate bonding with the core element 33 being produced at the same time.

Instead of just one metal band, several metal bands can also be wound like a multi-thread screw. In addition, the winding process can be repeated in order to produce several layers, one on the other.

The invention has been described relative to an eccentric screw pump. However, those skilled in the art will readily appreciate that the invention is in no way restricted to eccentric screw pumps. Instead, rotors for eccentric screw motors or mud motors can also be produced following the method of the invention shown, for example, in FIGS. 5 to 7. As a result of using this method, a displacement mechanism is obtained which contains a very resistant rotor.

According to the foregoing, in one embodiment the invention provides an eccentric screw pump or an eccentric screw motor that includes a rotor formed from an least two-layer tubular jacket. The outer layer of the jacket consists of material that is abrasion-resistant and/or corrosion-resistant.

The invention claimed is:

1. An eccentric screw pump or motor comprising:

a stator that defines a continuous stator bore having a helical configuration;

a helical rotor rotatably supported within the stator bore, said helical rotor including an inner metal tube and an outer steel tube made of a metal material different from the inner tube, said tubes being deformed into a helical configuration with the outer tube in closely conforming relation to the inner tube; a core element extending along and engaging relation within the helically deformed inner tube, and a coupling head connected to the rotor.

2. The eccentric screw pump or motor according to claim 1 wherein the outer tube material is more abrasion-resistant than the inner layer material.

3. The eccentric screw pump or motor according to claim 1 wherein the inner tube comprises of a seamless tube.

4. The eccentric screw pump or motor according to claim 1 wherein the inner tube material is a steel material.

5. The eccentric screw pump or motor according to claim 1 wherein the outer tube material comprises a corrosion-resistant steel.

6. The eccentric screw pump or motor according to claim 5 wherein the outer tube material comprises either V2A or V4A steel.

7. The eccentric screw pump or motor according to claim 5 wherein the elastomeric mass has a substantially constant wall thickness over a large part of the extent of stator.

8. The eccentric screw pump or motor according to claim 5 wherein the jacket has a helical configuration similar to the stator bore.

9. The eccentric screw pump or motor according to claim 5 wherein the jacket has a cylindrical configuration and the cladding has a cylindrical outer peripheral surface.

10. The eccentric screw pump or motor according to claim 1 wherein the core element is pressed in only in the area of thread valleys of the helically deformed inner tube to form at least one helical shallow groove so as to bond the inner tube in form-fitting fashion to the core element in the region of thread valleys.

11. The eccentric screw pump or motor according to claim 1 wherein at least one helical intermediate space is between the core element and the helically deformed inner tube.

12. The eccentric screw pump or motor according to claim 11 wherein the at least one helical intermediate space is filled with a mass.

13. The eccentric screw pump or motor according to claim 1 wherein the core element is tubular.

14. The eccentric screw pump or motor according to claim 1 wherein the core element is solid.

15. The eccentric screw pump or motor according to claim 1 wherein the at least one helical intermediate space is empty.

16. The eccentric screw pump or motor according to claim 1 wherein the stator includes a wall formed by an elastomeric mass.

17. The eccentric screw pump or motor according to claim 1 wherein the stator comprises a jacket with an elastomeric cladding.

18. The eccentric screw pump or motor according to claim 1 wherein the outer tube material is more corrosion-resistant than the inner tube material.

19. The eccentric screw pump or motor according to claim 1 wherein the outer tube material comprises an abrasion-resistant steel.

20. The eccentric screw pump or motor according to claim 1 in which said outer steel tube is separate from said inner metal tube and is elastically deformed into a spherical configuration about the inner tube.

21. A method for producing a rotor in an eccentric screw pump or motor having a stator including a continuous stator bore that has a helical configuration, the method comprising the steps:

preparing a cylindrical tube;

enclosing the cylindrical tube by winding at least one metal band about the inner tube with the windings abutting each other substantially without a gap so as to produce a double-walled structure;

heating the at least one metal band before winding onto the cylindrical tube; and deforming the double-walled structure to a helical configuration of the rotor.

* * * * *